US006642191B2

(12) United States Patent
Palazzotto et al.

(10) Patent No.: US 6,642,191 B2
(45) Date of Patent: Nov. 4, 2003

(54) LUBRICATING OIL ADDITIVE SYSTEM PARTICULARLY USEFUL FOR NATURAL GAS FUELED ENGINES

(75) Inventors: John D. Palazzotto, Castro Valley, CA (US); Mark R. Logan, San Ramon, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 09/998,640

(22) Filed: Nov. 29, 2001

(65) Prior Publication Data

US 2003/0148900 A1 Aug. 7, 2003

(51) Int. Cl.[7] ..... C10M 129/76; C10M 141/02

(52) U.S. Cl. ..... 508/501; 508/415; 508/519; 508/584

(58) Field of Search ..... 508/501, 390, 508/415, 519, 584

(56) References Cited

U.S. PATENT DOCUMENTS

| | | | | |
|---|---|---|---|---|
| 2,992,708 | A | | 7/1961 | Lyon |
| 3,018,250 | A | | 1/1962 | Anderson et al. |
| 3,018,291 | A | | 1/1962 | Anderson et al. |
| 3,024,237 | A | | 3/1962 | Drummond et al. |
| 3,100,673 | A | | 8/1963 | Ulmer et al. |
| 3,172,892 | A | | 3/1965 | Le Suer et al. |
| 3,219,666 | A | | 11/1965 | Norman et al. |
| 3,272,746 | A | | 9/1966 | Le Suer et al. |
| 3,361,673 | A | | 1/1968 | Stuart et al. |
| 3,381,022 | A | | 4/1968 | Le Suer |
| 3,912,764 | A | | 10/1975 | Palmer, Jr. |
| 3,981,813 | A | | 9/1976 | Den Herder et al. |
| 4,011,196 | A | | 3/1977 | Carevic et al. |
| 4,077,807 | A | | 3/1978 | Kramer et al. |
| 4,234,435 | A | | 11/1980 | Meinhardt et al. |
| 4,263,152 | A | | 4/1981 | King et al. |
| 4,272,387 | A | | 6/1981 | King et al. |
| 4,341,677 | A | | 7/1982 | Tamosauskas |
| 4,360,486 | A | | 11/1982 | DiBiasi et al. |
| 4,612,132 | A | | 9/1986 | Wollenberg et al. |
| 4,654,082 | A | | 3/1987 | Frilette |
| 4,747,965 | A | | 5/1988 | Wollenberg et al. |
| 4,764,295 | A | | 8/1988 | Le Coent |
| 5,112,507 | A | | 5/1992 | Harrison |
| 5,149,827 | A | | 9/1992 | Kita et al. |
| 5,241,003 | A | | 8/1993 | Degonia et al. |
| 5,266,186 | A | | 11/1993 | Kaplan |
| 5,286,799 | A | | 2/1994 | Harrison et al. |
| 5,319,030 | A | | 6/1994 | Harrison et al. |
| 5,320,765 | A | | 6/1994 | Fetterman, Jr. et al. |
| 5,334,321 | A | | 8/1994 | Harrison et al. |
| 5,356,552 | A | | 10/1994 | Harrison et al. |
| 5,370,805 | A | | 12/1994 | Smrcka et al. |
| 5,523,007 | A | * | 6/1996 | Kristen et al. ..... 508/501 |
| 5,571,586 | A | | 11/1996 | Gobran |
| 5,575,951 | A | | 11/1996 | Anderson |
| 5,595,964 | A | | 1/1997 | Bardasz |
| 5,629,063 | A | | 5/1997 | Gobran |
| 5,658,865 | A | * | 8/1997 | Yoshida et al. ..... 508/501 |
| 5,716,912 | A | | 2/1998 | Harrison et al. |
| 5,726,133 | A | | 3/1998 | Blahey et al. |
| 5,773,391 | A | | 6/1998 | Lawate et al. |
| 5,851,743 | A | | 12/1998 | Akao |
| 5,922,794 | A | | 7/1999 | Prabhu et al. |
| 5,998,119 | A | | 12/1999 | Aylward et al. |
| 6,140,281 | A | | 10/2000 | Blahey et al. |
| 6,140,282 | A | | 10/2000 | Cartwright et al. |
| 6,147,035 | A | | 11/2000 | Sougawa et al. |
| 6,191,081 | B1 | | 2/2001 | Cartwright et al. |

FOREIGN PATENT DOCUMENTS

| | | |
|---|---|---|
| EP | 0 391 651 A3 | 10/1990 |
| EP | 0 391 651 B1 | 10/1990 |
| EP | 0 391 651 A2 | 10/1990 |
| WO | WO 00/22070 | 4/2000 |

OTHER PUBLICATIONS www.cromptoncorp.com, Crompton Olefins & Styrenics Additives, "Polyol Stabilizers" Product Information (Naugard®PS–48), Nov. 20, 2001.

Ciba Specialty Chemicals Inc., Additives, Reference AD7, Publ. No. 28970/96/e, "Ciba® IRGANOX® L 135", 1996.

Ciba Safety Data Sheet, IRGANOX L 135, Revision Nov. 30, 2000.

A transfer of Chevron SS15633 was first discussed with Chevron Lubricants and Specialty Products in Houston, Texas on Jan. 7, 2000. This discussion was between a subsidiary and a parent company. Chevron SS15633 comprises an antioxidant that comprises 0.5 wt. % hindered phenol and 0.5 wt. % of molybdenum sulfide oxidation inhibitor described in U.S. Patent 4,263,152. The base oil used in SS15633 was a Group II base oil.

* cited by examiner

*Primary Examiner*—Jacqueline V. Howard
(74) *Attorney, Agent, or Firm*—Martin C. Fallon; Josetta Jones

(57) ABSTRACT

A lubricating oil comprising a major amount of at least one of Group II, III, and IV base oil and a minor amount of 3,5-di-t-butyl 4-hydroxy phenol propionate. A method of making this lubricating oil and a method of lubricating a natural gas engine with this lubricating oil.

46 Claims, No Drawings

LUBRICATING OIL ADDITIVE SYSTEM PARTICULARLY USEFUL FOR NATURAL GAS FUELED ENGINES

BACKGROUND

This invention relates to lubricating oil comprising a combination of a hindered phenol and Group II, III and IV base oil. The lubricating oil of this invention may be used in any manner, however its enhanced properties make it particularly applicable for use in engines fueled by natural gas.

Natural gas has a higher specific heat content than liquid hydrocarbon fuels and therefore it burns hotter than liquid hydrocarbon fuels under typical conditions. In addition, since it is already a gas, natural gas does not cool intake air by evaporation as liquid hydrocarbon fuel droplets do. Furthermore, many natural gas fueled engines are run either at or near stoichiometric conditions, at which less excess air is available to dilute and cool combustion gases. As a result, natural gas fueled engines generate higher combustion gas temperatures than engines burning liquid hydrocarbon fuels. Since the rate of formation of $NO_x$ increases exponentially with temperature, natural gas fueled engines may generate $NO_x$ concentrations high enough to cause severe nitration of lubricating oil.

In most cases, natural gas fueled engines are used continuously at 70 to 100% load, whereas an engine operating in vehicular service may only spend 50% of its time at full load. Lubricating oil drain intervals may vary in vehicular service, but are typically shorter than those for natural gas fueled engines.

It is important to ensure the reliability of natural gas fueled engines because natural gas fueled engines may be located in remote areas where service is not readily available. Lubricating oil used in natural gas engines therefore requires high resistance to oxidation and nitration.

Good valve wear control is important for keeping engine operating costs down and may be achieved by providing the proper amount and composition of ash. Minimizing combustion chamber deposits and spark plug fouling are also considerations in setting the ash content and composition in these oils. Lubricating oil ash levels are limited, so detergents must be carefully selected to minimize piston deposits and ring sticking. Good wear protection is required to prevent scuffing and corrosion.

If lubricating oils for natural gas fueled engines are not formulated to handle typical environments for those engines, the lubricating oil will deteriorate rapidly during use. This deterioration will typically cause the lubricating oil to thicken, which results in engine sludge, piston deposits, oil filter plugging, and in severe cases, accelerated ring and liner wear.

The general industry approach to reduce deterioration of lubricating oil and the resultant engine sludge, piston deposits, oil filter plugging and accelerated ring and liner wear is to add antioxidants such as hindered phenols as well as diphenyl amines and sulfurized compounds. Increasing the amount of these antioxidants in lubricating oil is increasingly effective to avoid lubricating oil deterioration. But at some point the solubility limit of the additional antioxidant reaches maximum effectiveness and at times further addition of antioxidant may even detrimentally affect piston deposit control.

While it is no surprise that increasing the amount of antioxidant is effective in increasing the life of lubricating oil, this invention provides a method to increase the life of lubricating oil with out necessarily increasing the amount of antioxidant.

SUMMARY

The lubricating oil of this invention may comprise a minor amount of one or more hindered phenols of the general formula:

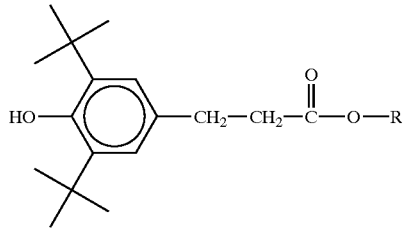

and a major amount of at least one of Group II, III and IV base oils. More specifically, the lubricating oil of this invention may comprise about 0.20 wt. % to about 3 wt. % of one or more hindered phenols having this general formula. Liquid hindered phenols are preferred. One embodiment of the lubricating oil of this invention may comprise one or more molybdenum oxidation sulfide inhibitors in an amount no more than 0.5% wt. Unless otherwise specified the term "wt. %" as used herein means wt. % of lubricating oil. One embodiment of this invention comprises a lubricating oil of claim 1 having a total base number of about 2.15 milligrams Potassium Hydroxide per gram of sample (mg KOH/gr) to about 8.88 mg KOH/gr as determined by ASTM D 2896. One embodiment of this invention comprises a lubricating oil having a total ash content of about 0.10 wt. % to about 1.50 wt. % as determined by ASTM D874. Lubricating oil of this invention may have less than 4000 ppm sulfur. One embodiment of this invention comprises combining the hindered phenol of the invention with the base oil in any order and mixing. Another embodiment of this invention comprises a method of lubricating engines comprising contacting one or more engines with the lubricating oil of this invention. Lubricating oil of this invention may comprise a major amount of at least one of Group II, III and IV base oil and a minor amount of 3,5-di-t-butyl 4-hydroxy phenol propionate. Lubricating oil of this invention may comprise about 0.20 wt. % to about 3 wt. % 3,5-di-t-butyl 4-hydroxy phenol propionate, preferably about 0.6 wt % to about 2.5 wt. %. The 3,5-di-t-butyl 4-hydroxy phenol propionate may be liquid. One embodiment of this invention may comprise an additive formulation comprising 3,5-di-t-butyl 4-hydroxy phenol propionate; one or more dispersants; one or more wear inhibitors; and one or more detergents. Lubricating oil of this invention may comprise about 1 wt. % to about 8 wt. % of one or more dispersants, about 1 wt. % to about 8.5 wt. % of one or more detergents, about 0.2 wt. % to about 1.5 wt. % of one or more wear inhibitors, about 0.5 wt. % to about 3 wt. % 3,5-di-t-butyl 4-hydroxy phenol propionate, and about 40 wt. % to about 97 wt. % of at least one of Group II, III and IV base oil or preferably about 80 wt. % to about 97 wt. % of at least one of Group II, III and IV base oil or more preferably about 60 wt. % to about 97 wt. % of at least one of Group I, III and IV base oil. Lubricating oil of this invention may comprise about 1.25 wt. % to about 6 wt. % of one or more dispersants; about 2 wt. % to about 6 wt. % of one or more detergents; about 0.3 wt. % to about 0.8 wt. % of one or more wear inhibitors, about 0.6 to about 2.5 wt. % 3,5-di-t-butyl 4-hydroxy phenol propionate and about 40 wt. % to about 97 wt. % of at least one of Group II, III and IV base oil or preferably about 80 wt. % to about 97 wt. % of at least one of Group II, III and IV base oil or more preferably about 60 wt. % to about 97 wt. % of at least one of Group II, III and IV base oil.

DETAILED DESCRIPTION OF THE INVENTION

This invention provides lubricating oil that may be used in any engine, but that has exhibited a surprisingly long life when tested in a natural gas fueled engine.

The lubricating oil of this invention may comprise one or more of the hindered phenols described herein and Group II, III and IV base oils. A preferred lubricating oil of this invention comprises a major amount of one or more base oils from Groups II through IV and a minor amount of the hindered phenols described herein. The term "major amount" when used herein means more than 40 wt. %. The term "minor amount" when used herein means less than 20 wt. %.

One embodiment of this invention comprises an additive formulation comprising one or more of the hindered phenols described herein, one or more dispersants, one or more detergents and one or more wear inhibitors.

A preferred lubricating oil of this invention may comprise a major amount of base oils from Group II through Group IV, a minor amount of one or more of the additive formulations comprising the hindered phenols described herein, one or more detergents, one or more dispersants and one or more wear inhibitors.

Another embodiment of this invention comprises lubricating oils comprising additive formulations comprising the hindered phenols described herein.

Preferred lubricating oil of this invention may comprise the hindered phenols described herein and Group II through IV base oils in a formulation that has about 0.10 wt. % to about 1.50 wt. % ash in the finished lubricating oil and more preferably about 0.3 wt. % ash to about 0.95 wt. % ash in the finished lubricating oil as determined by ASTM D874. When ash contents are discussed herein, the ash contents were determined by ASTM D874.

One embodiment of the lubricating oil of this invention may have a Total Base Number (TBN) of about 2.15 milligrams Potassium Hydroxide per gram of sample (mg KOH/gr) to about 8.88 mg KOH/gr. A more preferable embodiment would have a TBN from about 3 mg KOH/gr to about 8 mg KOH/gr. Unless otherwise specified, TBNs, as used herein, are determined by using the method ASTM D2896.

The lubricating-oil of this invention may have a sulfur content of less than 4000 ppm or 0.4 wt. %.

Another embodiment of this invention comprises methods of making the lubricating oils of this invention or the additive formulations of this invention by combining the components with agitation until all components are mixed. The ingredients may be combined in any order and at a temperature sufficient to blend the components but not high enough to degrade the components. A temperature of about 120 degrees F. to about 160 degrees F. may be used. Heating may occur at any time during the process.

Another embodiment of this invention comprises the method of lubricating one or more engines by contacting one or more of the lubricating oils of this invention with one or more engines.

Another embodiment of this invention comprises the method of lubricating one or more natural gas engines by contacting one or more of the lubricating oils of this invention with one or more natural gas engines.

Another embodiment of this invention comprises the method of lubricating one or more engines by lubricating one or more of the lubricating oils of this invention with one or more engines.

Another embodiment of this invention comprises the method of lubricating one or more natural gas engines by lubricating one or more of the lubricating oils of this invention with one or more natural gas engines.

The lubricating oil of this invention has shown a surprisingly long life in a natural gas fueled engine when the hindered phenols described herein are used in an additive formulation with Group II, III and IV base oils over that seen when the hindered phenols described herein were used in a similar additive formulation with Group I base oils or when other types of hindered phenols were used in a similar additive formulation with Group I or Group II base oils. The surprising long life exhibited by the lubricating oil of this invention may be the result of a synergistic effect of the Group II, III and IV base oils with the hindered phenols described herein and/or a synergistic effect of the Group II, III and IV base oils and the additive formulation comprising the hindered phenols described herein.

Base Oil

Base Oil as used herein is defined as a base stock or blend of base stocks. Base Stock as used herein is defined as a lubricant component that is produced by a single manufacturer to the same specifications (independent of feed source or manufacturers location): that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100 degrees Centigrade (C.) and about 5 centistokes (cSt) to about 20 cSt, preferably about 7 cSt to about 16 cSt, more preferably about 9 cSt to about 15 cSt. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity 20 cSt or higher at 100 degrees C.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in API categories II, III, IV and V. Saturates levels and viscosity indices for Group I, II and III base oils are listed in Table 1. Group IV base oils are polyalphaolefins (PAO). Group V base oils include all other base oils not included in Group I, II, III, or IV. Suitable base oils for use in this invention include those in API categories II, III and IV as defined in API Publication 1509, 14th Edition, Addendum I, December 1998. A summary of the characteristics of Group II, III and IV base oil is presented in Table I. Though Group II, III and IV base oils are preferred for use in this invention, these preferred Group II, III and IV base oils may be prepared by combining one or more of Group I, II, III, IV and V base stocks or base oils.

TABLE 1

Saturates, Sulfur and Viscosity Index of Group I, II and III Base Stocks

| Group | Saturates (As determined by ASTM D 2007) Sulfur (As determined by ASTM D 2270) | Viscosity Index (As determined by ASTM D 4294, ASTM D 4297 or ASTM D 3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil of this invention. A major amount of base oil as defined herein comprises 40 wt. % or more. Preferred amounts of base oil comprise about 40 wt. % to about 97 wt. % of at least one of Group II, III and IV base oil or preferably about 80 wt. % to about 97 wt. % of at least one of Group II, III and IV base oil or more preferably about 60 wt. % to about 97 wt. % of at least one of Group II, III and IV base oil. (When wt. % is used herein, it is referring to wt. % of the lubricating oil unless otherwise specified.) A more preferred embodiment of this invention may comprise an amount of base oil that comprises about 85 wt. % to about 95 wt. % of the lubricating oil.

A preferred lubricating oil of this invention may comprise Group II base oil. Preferred base oils may comprise base oil that is commercially available from Chevron Corporation in San Ramon, Calif., Pennzoil Quaker State Company in Houston, Tex., Conoco in Houston, Tex., Motiva Enterprises in Houston, Tex., ExxonMobil in Irving, Tex. and Petro Canada Lubricants in Mississauga, Ontario Canada. Other base oils useful in this invention may be commercially available throughout the world from other base oil suppliers.

II. Additive Formulation

When incorporated in lubricating oil, the additive formulation of this invention provides enhanced oxidation inhibition, nitration inhibition, total base retention, reduction in acid formation and reduction percent viscosity increase of lubricating oil.

One embodiment of the additive formulation of this invention may comprise of one or more dispersants, one or more detergents, one or more wear inhibitors and one or more hindered phenols described herein.

The lubricating oil of this invention may comprise an additive formulation that provides the lubricating oil with about 1 wt. % to about 8 wt. % of one or more dispersants, about 1 wt. % to about 8.5 wt. % of one or more detergents, about 0.2 wt. % to about 1.5 wt. % of one or more wear inhibitors and about 0.2 wt. % to about 3 wt. % and one or more hindered phenols described herein. The additive formulation of this invention may also comprise other additives traditionally used in the lubricating oil industry.

Another embodiment of a lubricating oil of this invention may comprise an additive formulation that provides the lubricating oil with about 1.25 wt. % to about 6 wt. % of one or more dispersants, about 2 wt. % to about 6 wt. % of one or more detergents, about 0.3 wt. % to about 0.8 wt. % of one or more wear inhibitors and about 0.6 wt. % to about 2.5 wt. % of one or more hindered phenols described herein. These components make up one embodiment of the additive formulation of this invention. The additive formulation of this invention may also comprise other additives traditionally used in the lubricating oil industry.

The additive formulation of this invention, may comprise diluent oil. It is known in the art to add diluent oil to additive formulations and this is called "trimming" the additive formulation. A preferred embodiment may be trimmed with any diluent oil typically used in the industry. This diluent oil may be a Group I or above oil. A preferred amount of diluent oil may comprise about 4.00 wt. %.

A. Hindered Phenol Antioxidant

One embodiment of this invention comprises one or more hindered phenols having the general formula:

(1)

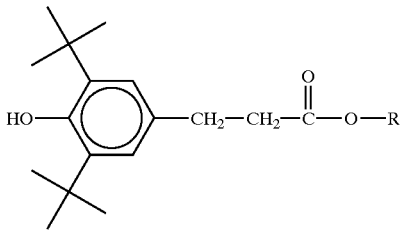

The lubricating oil of this invention may comprise the additive formulation of this invention that provides the lubricating oil with about 0.2 wt. % to about 3 wt. % of one or more hindered phenols having the general structural formula in (1). Preferred lubricating oils of this invention may comprise an additive formulation that provides the lubricating oil with about 0.6 wt. % to about 2.5 wt. % of one or more hindered phenols having the general structural formula in (1).

Another embodiment of the lubricating oil of this invention may comprise an additive formulation that provides the lubricating oil with 3,5-di-t-butyl 4-hydroxy phenol propionate. The hindered phenol, 3,5-di-t-butyl 4-hydroxy phenol propionate may be available commercially from Ciba Specialty Chemicals at 540 White Plains Road, Terrytown, N.Y. 10591 as IRGANOX L135® or Crompton Corporation at 199 Benson Road, Middlebury, Conn. 06749 as Naugard®PS48. IRGANOX L 135® and Naugard®PS48 are liquid high molecular weight phenolic antioxidants for use in lubricating oils.

Liquid hindered phenol is preferred.

Lubricating oil of this invention may comprise greater than about 0.2 wt. % to more than about 3 wt. % 3,5-di-t-butyl 4-hydroxy phenol propionate. Preferred lubricating oils of this invention comprise about 0.6 wt. % to about 2.5 wt. % 3,5-di-t-butyl 4-hydroxy phenol propionate.

Additional amounts of 3,5-di-t-butyl 4-hydroxy phenol propionate or additional types of hindered phenols or other antioxidants may reduce the synergistic effect of the 3,5-di-t-butyl 4-hydroxy phenol propionate and the base oil of Group II, III and IV that may be responsible for the surprising antioxidant properties presented herein in Examples 1 to 6.

B. Detergent

Any detergents commonly used in lubricating oils may be used in this invention. These detergents may or may not be overbased detergents or they may be low, neutral, medium, or high overbased detergents. For example, detergents of this invention may comprise sulfonates, salicylates and phenates. Metal sulfonates, salicylates and phenates are preferred. When the term metal is used with respect to sulfonates, salicylates and phenates herein, it refers to calcium, magnesium, lithium, magnesium, potassium and barium.

The detergent may be incorporated into the lubricating oil of this invention in an amount of about 1.0 wt. % to about 8.5 wt. %, preferably from about 2 wt. % to about 6 wt. %.

C. Dispersant

A preferred embodiment of the lubricating oil of this invention may comprise one or more nitrogen containing ashless dispersants of the type generally represented by succinimides (e.g., polyisobutylene succinic acid/anhydride (PIBSA)-polyamine having a PIBSA molecular weight of about 700 to 2500). The dispersants may or may not be borated or non-borated. The dispersant may be incorporated into the lubricating oil of this invention in an amount of about 1 wt. % to about 8 wt. %, more preferably in the amount of about 1.5 wt. % to about 6 wt. %.

Preferred dispersants for this invention comprise one or more ashless dispersants having an average molecular weight (mw) of about 1000 to about 5000. Dispersants prepared from polyisobutylene (PIB) having a mw of about 1000 to about 5000 are such preferred dispersants.

A preferred dispersant of this invention may be one or more succinimides. The term "succinimide" is understood in the art to include many of the amide, imide, etc. species that are also formed by the reaction of a succinic anhydride with an amine and is so used herein. The predominant product, however, is succinimide and this term has been generally accepted as meaning the product of a reaction of an alkenyl- or alkyl-substituted succinic acid or anhydride with a polyamine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,250; 3,018,291; 3,024,237; 3,100,673; 3,172,892; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are hereby incorporated by reference.

This invention may comprise one or more succinimides, which may be either a mono or bis-succinimide. This invention may comprise a lubricating oil involving one or more succinimide dispersants that have or have not been post treated.

D. Wear Inhibitor

Wear inhibitors such as metal dithiophosphates (e.g., zinc dialkyl dithiophosphate, ZDDP), metal dithiocarbamates, metal xanthates or tricresylphosphates may be included. Wear inhibitors may be present in the amount of about 0.24 wt. % to 1.5 wt. %, more preferably in the amount of about 0.3 wt. % to about 0.80 wt. %, most preferably in the amount of about 0.35 wt. % to about 0.75 wt. % of the lubricating oil. A preferred wear inhibitor is zinc dithiophosphate. Other wear inhibitors that may be included are zinc dialkyldithiophosphate and/or zinc diaryldithiophosphate (ZnDTP). The wear inhibitor may be incorporated into the lubricating oil of this invention in an amount of about 0.2 wt. % to 1.5 wt. %, more preferably in the amount of about 0.3 wt. % to about 0.8 wt. % of the lubricating oil. These values may include a small amount of hydrocarbon oil that was used in preparing zinc dithiophosphate. Preferred ranges of phosphorus in the finished lubricating oil are about 0.01 wt. % to about 0.11 wt. %, more preferably about 0.02 wt. % to about 0.07 wt. %.

The alkyl group in the zinc dialkyldithiophosphate may be, for example, a straight or branched primary, secondary or tertiary alkyl group of about 2 to about 18 carbon atoms. Examples of the alkyl groups include ethyl, propyl, isopropyl, butyl, pentyl, hexyl, heptyl, octyl, decyl, dodecyl, and octadecyl.

The alkylaryl group of the zinc dialkylaryldithiophosphate is, for example, a phenyl group having an alkyl group of about 2 to about 18 carbon atoms, such as butylphenyl group, nonylphenyl group, and dodecylphenyl group.

III. Other Additive Components

The following additive components are examples of some of the components that may be favorably employed in this invention. These examples of additives are provided to illustrate this invention, but they are not intended to limit it:

A. Antioxidants

Additional antioxidants are not required to provide the enhanced oxidation, nitration and reduced viscosity increase properties of this invention, but embodiments of this invention may include the use of additional antioxidants. For example, one embodiment of this invention may comprise one or more hindered phenols of the general formula (1) and one or more molybdenum oxidation inhibitors such as that described in U.S. Pat. No. 4,263,152 in an amount no more than about 0.3 wt. % or in an amount no more than 0.5 wt. %. In some embodiments of this invention, no molybdenum oxidation inhibitor was added.

The description of the molybdenum oxidation inhibitor in U.S. Pat. No. 4,263,152 is incorporated herein by reference. A method for preparing the molybdenum oxidation inhibitor described in U.S. Pat. No. 4,263,152 that may be used in one embodiment of this invention is to prepare a solution of the acidic molybdenum precursor and a polar promoter with a basic nitrogen-containing compound with or without diluent. Diluent may be used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. This reaction may be carried out at a temperature from the melting point of the mixture to reflux temperature. It is ordinarily carried out at atmospheric pressure although higher or lower pressures may be used if desired. This reaction mixture may be treated with a sulfur source at a suitable pressure and temperature for the sulfur source to react with the acidic molybdenum and basic nitrogen compounds. Preferred sulfur sources are sulfur, hydrogen sulfide, phosphorus pentasulfide, $R_2 S_x$ where R is hydrocarbyl, preferably $C_{1-10}$ alkyl, and x is at least 3, mercaptans wherein R is $C_{1-10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides. Water may be removed from the reaction mixture prior to completion of reaction with the sulfur source.

Embodiments of this invention may comprise, in addition to the hindered phenols described herein, such antioxidants including but not limited to phenol type (phenolic) oxidation inhibitors, such as 4,4'-methylene-bis(2,6-di-tert-butylphenol), 4,4'-bis(2,6-di-tert-butylphenol),
4,4'-bis(2-methyl-6-tert-butylphenol),
2,2'-ethylene-bis(4-methyl-6-tert-butylphenol),
4,4'-butylidene-bis(3-methyl-6-ert-butylphenol),
4,4'-isopropylidene-bis(2,6-di-tert-butylphenol),
2,2'-methylene-bis(4-methyl-6-nonylphenol),
2,2'-isobutylidene-bis(4,6-dimethylphenol),
2,2'-methylene-bis(4-methyl-6-cyclohexylphenol),
2,6-di-tert-butyl-4-methylphenol, 2,6-di-tert-butyl-4-ethylphenol,
2,4-dimethyl-6-tert-butyl-phenol, 2,6-di-tert-1-dimethylamino-p-cresol,
2,6-di-tert-4-(N,N'-dimethylaminomethylphenol),
4,4'-thiobis(2-methyl-6-tert-butylphenol),
2,2'-thiobis(4-methyl-6-tert-butylphenol),
bis(3-methyl-4-hydroxy-5-tert-butylbenzyl)-sulfide, and
bis(3,5-di-tert-butyl-4-hydroxybenzyl). Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and methylenebis (dibutyldithiocarbamate).

One embodiment of this invention comprises one or more hindered phenols having the general formula:

(2)

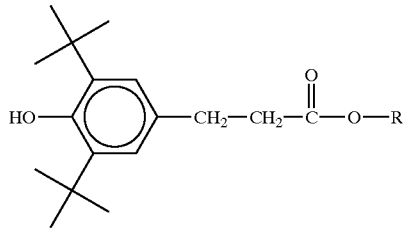

and no other antioxidant additive. Another embodiment of this invention comprises 3,5-di-t-butyl 4-hydroxy phenol propionate commercially from Ciba Specialty Chemicals at 540 White Plains Road, Terrytown, N.Y. 10591 as IRGANOX L135® or Crompton Corporation at 199 Benson Road, Middlebury, Conn. 06749 as Naugard®PS48 and no other antioxidant.

B. Wear Inhibitors

In addition to the wear inhibitors mentioned in the additive formulation section, other traditional wear inhibitors may be used. As their name implies, these agents reduce wear of moving metallic parts. Examples of such agents include, but are not limited to, phosphates, phosphites, carbamates, esters, sulfur containing compounds, and molybdenum complexes.

C. Rust Inhibitors (Anti-Rust Agents)

Applicable rust inhibitors include:

1. Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate; and 2. Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

D. Demulsifiers

Demulsifiers that may be used include addition products of alkylphenol and ethylene oxide, polyoxyethylene alkyl ether, and polyoxyethylene sorbitan ester.

E. Extreme Pressure Agents (EP Agents)

EP Agents that may be used include Zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate.

F. Friction Modifiers

Fatty alcohol, fatty acid, amine, borated ester, and other esters.

G. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound may be used.

H. Viscosity Index Improvers

Polymethacrylate type polymers, ethylene-propylene copolymers, styrene-isoprene copolymers, hydrated styrene-isoprene copolymers, polyisobutylene, and dispersant type viscosity index improvers may be used.

I. Pour Point Depressants

Polymethyl methacrylate may be used.

J. Foam Inhibitors

Alkyl methacrylate polymers and dimethyl silicone polymers may be used.

IV. Lubricating Oil for Natural Gas Fueled Engines

There is a difference in the lubricating oil requirements for natural gas fueled engines and engines that are fueled by liquid hydrocarbon fuels. The combustion of liquid hydrocarbon fuels such as diesel fuel often results in a small amount of incomplete combustion (e.g., exhaust particulates). In a liquid hydrocarbon fueled engine, these incombustibles provide a small but critical degree of lubrication to the exhaust valve/seat interface, thereby ensuring the durability of both cylinder heads and valves. The combustion of natural gas fuel is often very complete, with virtually no incombustible materials. Therefore, the durability of the cylinder head and valve is controlled by the ash content and other properties of the lubricating oil and its consumption rate. There are no incombustible materials to aid in lubrication to the exhaust valve/seat interface in a natural gas fueled engine. Natural gas fueled engines burn fuel that is introduced to the combustion chamber in the gaseous phase. This has a significant affect on the intake and exhaust valves because there is no fuel-derived lubricant for the valves like liquid droplets or soot. Consequently, gas engines are solely dependent on the lubricant ash to provide lubricant between the hot valve face and its mating seat. Too little ash or the wrong type can accelerate valve and seat wear, while too much ash may lead to valve guttering and subsequent valve torching. Too much ash can also lead to detonation from combustion chamber deposits. Consequently, gas engine builders frequently specify a narrow ash range that they have learned provides the optimum performance. Since most gas is low in sulfur, excess ash is generally not needed to address alkalinity requirements, and ash levels are largely optimized around the needs of the valves. There may be exceptions to this in cases where sour gas or landfill gas is used.

Natural gas fueled engine lubricating oils are classified according to their ash content. The lubricant ash acts as a solid lubricant to protect the valve/seat interface in place of naturally occurring exhaust particles in a hydrocarbon fueled engine. The oil industry has accepted guidelines that classify natural gas fueled engine lubricating oil according to their ash level. The classifications of natural gas fueled engine lubricating oil according to their ash levels are presented in Table 2.

TABLE 2

Classifications of Lubricating Oils for Natural Gas Fueled Engines According To Ash Levels

| Ash Designation | Sulfated Ash Level (wt. %. Determined by ASTM D874) |
|---|---|
| Ashless | 0 < Ash < 0.15 |
| Low Ash | 0.15 < Ash < 0.6 |
| Medium Ash | 0.6 < Ash < 1.0 |
| High Ash | Ash > 1.0 |

The ash level of lubricating oil is often determined by its formulation components. Metal-containing detergents (e.g., barium, calcium) and metallic-containing wear inhibitors contribute to the ash level of lubricating oils. For correct engine operation, gas engine manufacturers define lubricating oil ash requirements as part of the lubricating oil specifications. For example, manufacturers of 2-cycle engines often require natural gas engine lubricating oil to be Ashless to minimize the extent of harmful deposits that form on the piston and combustion chamber area. Manufacturers of 4-cycle engines often require natural gas engine lubricating oils to be Low, Medium or High Ash levels, refer to Table 2, to provide the correct balance of engine cleanliness and durability of the cylinder head and valves. Running the engine with lubricating oil with too low an ash level will likely result in shortened life for the valves or cylinder head. Running the engine with lubricating oil having too high an ash level will likely cause excessive deposits in the combustion chamber and upper piston area.

The degree of nitration of the lubricating oil may vary significantly depending on the engine design and operating conditions. Lean burn engines produce less $NO_x$ than their stoichiometric counterparts, so they tend to nitrate the oils less. Some operators may richen the air/fuel mixture on natural gas fueled engines to increase power output and consequently increase oil nitration levels. Lubricating oils with good nitration resistance are required in most natural gas engine installations because the lubricating oil may be used to lubricate a number of engines including stoichiometric and lean-burn models.

This invention will be further illustrated by the following examples that set forth particularly preferred embodiments. While the examples are provided to illustrate this invention, they are not intended to limit it.

EXAMPLES

The Examples describe experiments performed using Samples A through I. Multiple experiments were performed in each example using a variety of sulfonate, phenate and salicylate detergents; succinimide dispersants; and zinc dithiophosphate wear inhibitors. The examples are explained using the terms detergent, dispersant and wear inhibitor because no significant difference was found when these components were varied.

Sample A was prepared by combining about 0.91 wt. % 3,5-di-t-butyl 4-hydroxy phenol propionate, about 3.3 wt. % dispersant, about 3.4 wt. % detergent, about 0.38 wt. % wear inhibitor, 5 ppm foam inhibitor and Group II base oil. Sample A was prepared by combining the components at 140 degrees F. with agitation until all components were mixed.

Sample B was prepared by combining about 0.91 wt. % 3,5-di-t-butyl 4-hydroxy phenol propionate, about 3.3 wt. % dispersant, about 3.4 wt. % detergent, about 0.38 wt. % wear inhibitor, 5 ppm foam inhibitor and Group I base oil. Sample B was prepared by combining the components at 140 degrees F. with agitation until all components were mixed.

Sample C was prepared by combining about 1.25 wt. % 3,5-di-t-butyl 4-hydroxy phenol propionate, about 3 wt. % dispersant, about 3.4 wt. % detergent, about 0.38 wt. % wear inhibitor, 5 ppm foam inhibitor and Group II base oil. Sample C was prepared by combining the components at 140 degrees F. with agitation until all components were mixed.

Sample D was prepared by combining about 1.25 wt. % 3,5-di-t-butyl 4-hydroxy phenol propionate, about 3 wt. % dispersant, about 3.4 wt. % detergent, about 0.38 wt. % wear inhibitor, 5 ppm foam inhibitor and Group I base oil. Sample D was prepared by combining the components at 140 degrees F. with agitation until all components were mixed.

Sample E was Mobil Pegasus 805 commercially available from ExxonMobil Corporation in Fairfax, Va.

Sample F was prepared by using OLOA 1255, commercially available from Chevron Oronite Company in Houston, Texas. The OLOA 1255 was mixed with Group I base oil under typical blending conditions of about 140 degrees F. with agitation until all components are thoroughly mixed. As explained in of U.S. Pat. No. 5,726,133 lubricating oil made by combining OLOA 1255 is one of the most widely sold gas engine oil additive formulations and represents, therefore, a "benchmark standard" against which other formulations useful as engine oils may be measured.

Sample G was prepared by using OLOA 1255, commercially available from Chevron Oronite Company in Houston, Tex. The OLOA 1255 was mixed with Group II base oil under typical blending conditions of about 140 degrees F with agitation until all components were thoroughly mixed. As explained in of U.S. Pat. No. 5,726,133 lubricating oil made by combining OLOA 1255 is one of the most widely sold gas engine oil additive formulations and represents, therefore, a "benchmark standard" against which other formulations useful as engine oils may be measured.

Sample H was a commercially available lubricating oil designated as Chevron Oronite lab code R10994.

Sample I was SS15633 commercially available from Chevron Oronite LLC.

results demonstrate that Sample A and C show enhanced oxidation resistance when compared to samples B and D through I.

Surprisingly, when oil hour measurements were taken, the performance of the Sample A and Sample C exceeded that of comparative Samples B, D, E, F, G, and I. The only Sample that exhibited similar oxidation performance was Sample H. Although it is unknown what exact type and the exact amount of antioxidant(s) that are in Sample H, it was estimated to have approximately 2 wt. % antioxidant when analyzed by thin layer chromatography, whereas, Sample A and Sample C have 0.91 wt. % and 1.25 wt. % of antioxidant respectively. Therefore, Sample A has approximately 54% less antioxidant than Sample H and Sample C has about 37% less antioxidant than Sample H. The higher oxidation resistance exhibited by Sample A and Sample C may be due to a synergy of 3,5-di-t-butyl 4-hydroxy phenol propionate and Group II base oil or a synergy of the additive formulation comprising 3,5-di-t-butyl 4-hydroxy phenol propionate and Group II base oil.

TABLE 3

Oxidation-Resistance Bench Test Results

| | Sample A | Sample B | Sample C | Sample D | Sample E | Sample F | Sample G | Sample H | Sample I |
|---|---|---|---|---|---|---|---|---|---|
| Ratio* | 1.98 | 1.27 | 2.14 | 1.27 | 0.97 | 1.00 | 1.59 | 2.04 | 1.67 |
| % Difference compared to Sample F** | 98 | 27 | 114 | 27 | −3 | 0 | 59 | 104 | 67 |

*Ratio These numbers are relative ratios compared to Sample F's performance in this test. Numbers larger than 1.00 perform better than Sample F and less than 1.00 perform worse than the reference. The higher the ratio number, the higher the performance of the sample.
**% Difference These numbers are the percentage difference between Sample F and the comparative Sample. A negative number indicates worse performance than Sample F.

Sample J was prepared by combining the components of Sample A except that instead of a Group II base oil, Sample J comprises a Group III base oil.

Sample K was prepared by combining the components of Sample A except that instead of a Group II base oil, Sample K comprises a Group IV base oil.

Example 1

Oxidation-Resistance Bench Test

The Oxidation-Resistance Bench Test shows the capacity of lubricating oil to resist oxidation. This is one method that is used to analyze the performance of an oil to inhibit the incorporation of oxygen into oil. The results of this test are the number of hours it takes for samples to oxidize and absorb one liter of oxygen. The longer the time it takes for a sample to oxidize, the more resistant the sample is to oxidation.

All measurements are reported on a relative measurement basis so that large results or values represent greater levels of oxidation resistance. Lower numbers represent shorter oil life. Sample F was the reference oil and all results are reported as a ratio, which is the sample time divided by Sample F time. For example, if oil has a test result of 1.03, this sample would have a 3% increased performance over the reference sample. Sample F was the reference sample for the results reported in Table 3.

The Oxidation-Resistance bench tests were performed on Samples A through I. Results are presented in Table 3. The

Example 2

The Oxidation-Nitration And Viscosity Increase Resistance Test

The Oxidation-Nitration and Viscosity Increase Resistance bench test demonstrates the capacity of lubricating oil to resist oxidation, nitration and viscosity increase. This test is an additional tool to help determine the performance of oils as they relate to the actual service of lubricating engines that use natural gas as a fuel source. The level of oxidation and nitration of oil, may also be compared by monitoring the viscosity increase of the oil. The lower the values for oxidation, nitration and viscosity increase at the end the test, the more superior the product's performance. The Oxidation-Nitration and Viscosity Increase Resistance bench test was designed to simulate Caterpillar 3500 series engine conditions as related to actual field performance of the Caterpillar 3516 model. Oxidation-Nitration and Viscosity Increase Resistance tests were performed on Samples A, B, C, D, and F through I. The samples were placed in a heated glassware bath and subjected to calibrated levels of nitrous oxide gas over a specific period of time. The tests were run on each sample in duplicate and the results are an average of the two runs. The samples were evaluated using differential infra red spectroscopy before placing them in the heated glassware bath to determine a base line for each sample. The samples were reevaluated at the end of testing period. The differential between the base line data, absorbance units at 5.8 and 6.1 microns, and the data taken at the end of test cycle provides an indication of the oxidation-nitration resistance of the samples.

Differential infra red spectroscopy measures the amount of light that is absorbed by an oil sample and provides a unit of measure called an absorbance unit. DIR (Differential Infrared) spectra was determined by subtracting the fresh oil spectra from the used oil spectra to observe changes that have occurred due to oxidation, nitration, fuel dilution, soot accumulation, and or contamination. Typically a 0.1 millimeter (mm) cell is used, however an ATR crystal setup may be used after determining its associated path length. If the instrument does not have software that determines path length, the path length may be back calculated by measuring oxidation with a calibrated 0.1 mm cell. The variation between ATR and vertical cell measurements is minimal if restricted to the narrow area of oxidation and nitration (~1725 to 1630 $cm^{-1}$).

DIR Oxidation was measured from peak maximum at ~1715±5 $cm^{-1}$ to the spectra baseline (in units of absorbance).

DIR Nitration was measured from peak maximum at ~1630±1 $cm^{-1}$ to peak baseline (in units of absorbance).

During the Oxidation-Resistance Bench Test, the viscosity increases of the samples were measured at 100° C. by ASTM D 445. The viscosity increase is a percentage that compares the initial "fresh" kinematic viscosity with the end of test "used" oil kinematic viscosity. The formula to calculate for % viscosity difference is:

$$\%\ \text{Viscosity difference} = (\text{Sample}(x)_{initial} - \text{Sample}(x)_{final})/\text{Sample}(x)_{initial} \times 100\%$$

Oxidation levels of 5.8 microns and Nitration levels of 6.1 microns were used as peak height comparisons.

Measurements are reported on a relative measurement basis so that large results or values represent greater levels of oxidation-nitration and viscosity increase resistance. Lower numbers represent shorter oil life. Sample F was used as a reference oil and the results in the Tables 4, 5 and 6 were reported as a ratio in the first row of each table. This ratio was calculated by dividing measurements for Sample F by the measurements taken using the sample being compared to sample F. The second row of each table displays the percent difference between the reference Sample F and the samples being compared to Sample F. The larger the percentage difference between Sample F and the other samples, the better performing the sample in respect to oxidation resistance. Sample F was the reference sample for the results reported in Table 4–6. The formula to calculate percentage difference of the ratios compared to Sample F for Tables 4–6 is:

$$\%\ \text{difference} = (\text{Sample}(x) - \text{Sample}\ F)/\text{Sample}(x) \times 100\%$$

TABLE 4

Oxidation Resistance Test Results

| | Sample A | Sample B | Sample C | Sample D | Sample F | Sample G | Sample H | Sample I |
|---|---|---|---|---|---|---|---|---|
| Ratio* | 5.16 | 0.81 | 6.38 | 0.63 | 1.00 | 4.10 | 2.63 | 3.56 |
| % Difference compared to Sample F** | 81 | −23 | 84 | −58 | 0 | 76 | 62 | 72 |

*Ratio These numbers are relative ratios compared to Sample F's performance in this test. Numbers larger than 1.00 perform better than Sample F and less than 1.00 perform worse than the reference. The higher the ratio number, the higher the performance of the sample.
**% Difference These numbers are the percentage difference between Sample F and the comparative Sample. A negative number indicates worse performance than Sample F.

The results presented in Table 4 indicate that Sample A and C exhibited an 81% to 84% improvement, respectively, in oxidative resistance over the reference Sample F.

TABLE 5

Nitration Resistance Test Results

| | Sample A | Sample B | Sample C | Sample D | Sample F | Sample G | Sample H | Sample I |
|---|---|---|---|---|---|---|---|---|
| Ratio* | 3.85 | 1.06 | 87.00 | 1.75 | 1.00 | 4.22 | 29.00 | 1.83 |
| % Difference compared to Sample F** | 74 | 5 | 99 | 43 | 0 | 76 | 97 | 45 |

*Ratio These numbers are relative ratios compared to Sample F's performance in this test. Numbers larger than 1.00 perform better than Sample F and less than 1.00 perform worse than the reference. The higher the ratio number, the higher the performance of the sample.
**% Difference These numbers are the percentage difference between Sample F and the comparative Sample. A negative number indicates worse performance than Sample F.

The results in Table 5 indicate the improved performance of Samples A and C over the reference sample. The improvement ranged from 74% to 99% over the reference sample in nitration resistance.

TABLE 6

Viscosity Increase Resistance Test Results

| | Sample A | Sample B | Sample C | Sample D | Sample F | Sample G | Sample H | Sample I |
|---|---|---|---|---|---|---|---|---|
| Ratio* | 3.14 | 0.66 | 23.98 | 0.75 | 1.00 | 6.03 | 17.64 | 4.40 |
| % Difference compared to Sample F** | 68 | −52 | 104 | −34 | 0 | 83 | 94 | 77 |

*Ratio These numbers are relative ratios compared to Sample F's performance in this test. Numbers larger than 1.00 perform better than Sample F and less than 1.00 perform worse than the reference. The higher the ratio number, the higher the performance of the sample.
**% Difference These numbers are the percentage difference between Sample F and the comparative Sample. A negative number indicates worse performance than Sample F.

The results in Table 6 indicate the improved performance of Samples A and C over the reference sample. The improvement ranged from 68% to 104% over the reference sample in viscosity increase resistance.

Samples A and C perform superior to the reference sample with respect to oxidation, nitration and viscosity increase. Sample C performed better than all the samples tested with respect to oxidation, nitration and viscosity increase. These tests that quantify a lubricating oil's resistance to oxidation and nitration and the resultant viscosity increase are used to determine whether samples are good candidates for extending the life of lubricating oil particularly those lubricating oils for use in natural gas fueled engines. Absorbing oxygen and nitrogen and the resultant viscosity increase associated with absorbing oxygen and nitrogen are undesirable for lubricating oil particularly lubricating oils for use in natural gas fueled engines.

Example 3

Sample A, D, F, and G were tested separately by using each one as a lubricant in a Caterpillar 3516 natural gas fueled engine. Because the Caterpillar 3500 series natural gas fueled engines are one of the most commonly used and one of the most severe engines with respect to oil life, they were used as a tool to determine the life of lubricating oil. These tests were run in the same model of Caterpillar 3516 engine at the same location to minimize the amount of variables that are introduced in the testing environment. Oil life as used herein is the length of time it takes for a lubricating oil to reach Caterpillar's condemning limits for natural gas fueled engine lubricating oil. At the time of testing the Caterpillar limits are presented in Table 7.

TABLE 7

Caterpillar Limits at Time of Testing

| Test | Caterpillar Limit |
|---|---|
| Oxidation | 25 abs/cm$^{-1}$ by differential infra red spectroscopy |
| Nitration | 25 abs/cm$^{-1}$ by differential infra red spectroscopy |
| Viscosity Increase | 3 cSt increase over fresh oil |
| Total Base Number (TBN) | 50% of fresh oil TBN by ASTM D 2896 |
| Total Acid Number (TAN) | 2.0 number increase over the fresh oil or 3.0 maximum TAN by ASTM D 664 |

Both samples were run in the Caterpillar 3516 until the condemning limits were exceeded. The oxidation and nitration of the samples were analyzed using differential IR as described in Example 2. Viscosity Increase of the samples was also monitored. The Viscosity Increase analysis is described in Example 2. Sample A exhibited better performance with respect to oxidation, nitration and viscosity increase than Samples D, F, and G. Total Base Number (TBN) and Total Acid Number (TAN) analyses were also performed. TBN refers to the amount of base equivalent to milligrams of KOH in one gram of sample. Thus, higher TBN numbers reflect more alkaline products, and therefore a greater alkalinity reserve. The TBN of a sample may be determined by ASTM Test No. D2896. TAN refers to the amount of acid equivalent to milligrams of Potassium Hydroxide (KOH) in 1 gram of sample. TAN can be determined by the procedure described in ASTM D664.

Sample A outperformed the reference Sample F in all the monitored tests from 176% for TAN level to an estimated percentage of 374% for oil life based on the condemning limit for percent viscosity increase.

Sample A also outperformed Sample G which is the same additive as Sample F, but in a Group II base oil.

The key parameters that are the first to reach the Caterpillars condemning limit are TBN and TAN. In a comparison of the next highest products tested in Table 8, Sample A outperformed Sample G by 33% for TBN retention and 65% in the oils ability to inhibit acid production (TAN).

Sample D is similar to Sample F in its composition, but it contains a different quantity and type of antioxidant, formulated in a Group I base oil. The performance of Sample D is worse than Sample F, when evaluated in a Caterpillar field test.

The calculation formula for Relative Percent Improvement for Table 8 is:

$$\text{Relative Percent Improvement}=(\text{Sample}(x)-\text{Sample } F)/\text{Sample}(x)\times 100\%$$

TABLE 8

Oxidation, Nitration, Viscosity Increase, TBN and TAN Results for Caterpillar Test of Samples A, D, F, and G

| | Sample A | Sample D | Sample F | Sample G |
|---|---|---|---|---|
| Hours to Reach Caterpillar Limit for Oxidation | 1894 | 475 | 479 | 1082 |
| Relative Percent Improvement Comparison to Sample F for Oxidation | 295 | −1 | 0 | 126 |
| Hours to Reach Caterpillar Limit for Nitration | 1256 | 496 | 450 | 765 |
| Relative Percent Improvement Comparison to Sample F for Nitration | 179 | 10 | 0 | 70 |

TABLE 8-continued

Oxidation, Nitration, Viscosity Increase, TBN and TAN Results for Caterpillar Test of Samples A, D, F, and G

| | Sample A | Sample D | Sample F | Sample G |
|---|---|---|---|---|
| Hours to Reach Caterpillar Limit for Viscosity Increase | 3632* | 600 | 767 | 2099 |
| Relative Percent Improvement Comparison to Sample F for Viscosity Increase | 374 | −22 | 0 | 174 |
| Hours to Reach Caterpillar Limit for TBN | 1155 | 408 | 408 | 866 |
| Relative Percent Improvement Comparison to Sample F for TBN | 183 | 0 | 0 | 112 |
| Hours to Reach Caterpillar Limit for TAN | 1176 | 392 | 426 | 714 |
| Relative Percent Improvement Comparison to Sample F for TAN | 176 | −8 | 0 | 68 |

*Note
The viscosity increase hours for Sample A is an estimate based on trend analysis of the Used Oil Analysis (UOA).

Example 4

(a) Comparison of Samples A and G

Samples A and G were tested separately by using each one as a lubricant in the same Caterpillar 3516 natural gas fueled engine for about 1 year. The oxidation and nitration of the samples were analyzed using differential IR as described in Example 2. Viscosity Increase of the samples was monitored by using the Viscosity Increase test described in Example 2. Total Base Number (TBN) and Total Acid Number (TAN) analyses were also performed. As described in Example 3.

The performance of Sample A was surprising and unexpected compared to Sample G. Both samples were formulated in Group II base oil and in the critical parameters of TBN and TAN performance, Sample A had an increased oil life of 75% and 38%, respectively, when compared to Sample G.

The calculation formula for Relative Percent Improvement for Table 9 is:

$$\text{Relative Percent Improvement}=(\text{Sample}(x)-\text{Sample } G)/\text{Sample}(x)\times 100\%$$

TABLE 9

| | Sample A | Sample G |
|---|---|---|
| Hours to Reach Caterpillar Limit for Oxidation | 1984 | 1506 |
| Relative Percent Improvement Comparison to Sample G for Oxidation | 32 | 0 |
| Hours to Reach Caterpillar Limit for Nitration | 2965* | 2632* |
| Relative Percent Improvement Comparison to Sample G for Nitration | 13 | 0 |
| Hours to Reach Caterpillar Limit for Viscosity Increase** | 3381* | 3080* |
| Relative Percent Improvement Comparison to Sample G for Viscosity Increase | 10 | 0 |
| Hours to Reach Caterpillar Limit for TBN | 1733 | 990 |
| Relative Percent Change Improvement Comparison to Sample G for TBN | 75 | 0 |
| Hours to Reach Caterpillar Limit for TAN | 1538 | 1111 |

TABLE 9-continued

| | Sample A | Sample G |
|---|---|---|
| Relative Percent Improvement Comparison to Sample G for TAN | 38 | 0 |

*Note
The nitration level and viscosity increase hours for Sample A are an estimate based on trend analysis of the Used Oil Analysis (UOA).

(b) Comparison of Samples B and F

Samples B and F were tested separately by using each one as a lubricant in the same Caterpillar 3516 natural gas fueled engine for about 1 year. The oxidation and nitration of the samples were analyzed using differential IR as described in Example 2. Viscosity Increase of the samples was monitored by using the Viscosity Increase test described in Example 2. Total Base Number (TBN) and Total Acid Number (TAN) analyses were also performed using the testing described in Example 4.

The performance of Sample B was slightly better when compared to Sample F. Both samples were formulated in Group I base oil and in the critical parameters of TBN and TAN performance, Sample B had an increased oil life of only 20% and 16%, respectively, when compared to Sample F. The calculation formula for Relative Percent Improvement for Table 10 is:

$$\text{Relative Percent Improvement}=(\text{Sample}(x)-\text{Sample } F)/\text{Sample}(x)\times 100\%$$

TABLE 10

| | Sample B | Sample F |
|---|---|---|
| Hours to Reach Caterpillar Limit for Oxidation | 958 | 825 |
| Relative Percent Improvement Comparison to Sample F for Oxidation | 16 | 0 |
| Hours to Reach Caterpillar Limit for Nitration | 1116 | 1002 |
| Relative Percent Improvement Comparison to Sample F for Nitration | 11 | 0 |
| Hours to Reach Caterpillar Limit for Viscosity Increase | 1364* | 1304* |
| Relative Percent Improvement Comparison to Sample F for Viscosity Increase | 4.6 | 0 |
| Hours to Reach Caterpillar Limit for TBN | 693 | 578 |
| Relative Percent Improvement Comparison to Sample F for TBN | 20 | 0 |
| Hours to Reach Caterpillar Limit for TAN | 800 | 690 |
| Relative Percent Improvement Comparison to Sample F for TAN | 16 | 100 |

*Note
The viscosity increase hours for Sample B and Sample F are an estimate based on trend analysis of the Used Oil Analysis (UOA).

(c) Comparison of Examples 4(a) and 4(b)

The performance of Sample A shows a significant improvement over Sample G. Sample A and G both include Group II base oils. The performance increase in the parameters that reach the Caterpillar's condemning limit first, TBN and TAN levels show Sample A with a 75% and 38% improvement, respectively, compared to Sample G.

Sample B performed slightly better than Sample F. Comparing the same parameters of Sample B and Sample F to Samples A and G, TBN and TAN levels, show a 20% and 16% improvement, respectively. Sample A exhibits a surprising and unexpected improvement when used with Group II base oils.

Example 5

Samples C and E were tested separately by using each one as a lubricant in the same model Caterpillar 3516 natural gas fueled engine at the same location. Sample C was tested by using it as a lubricant for a Caterpillar 3516 for over 6 months. Sample E was tested by using it as a lubricant for a Caterpillar 3516 for about 1 year. The oxidation and nitration of the samples were analyzed using differential IR as described in Example 2. Viscosity Increase of the samples was monitored by using the Viscosity Increase test described in Example 2. Total Base Number (TBN) and Total Acid Number (TAN) analyses were also performed, as described in Example 3.

Sample C exhibited surprisingly better performance with respect to the reduction in oxidation, nitration, viscosity increase, TBN and TAN than Sample E. The level of performance improved from a minimum of 87% increase for oxidation to 101% and 108% for the key areas of TBN and TAN, respectively.

The level of nitration and viscosity increase of the oil for Sample C rose at a low rate. When this rate is used to estimate the number of hours it takes for oil to be condemned, it would be in excess of 15,000 hours. This would be an unfair comparison because Sample C would have been well below the minimum limits for TBN after 1152 hours of operation. Even though Sample C was drained well beyond this condemning limit. To give a realistic perspective of the Nitration and Viscosity Increase performance, two additional lines were added to the chart, which shows the level of nitration in absorbance units and viscosity increase for Sample C at the same hours when Sample E reached the limit. The nitration level for Sample C was 1.83 when Sample E reached the Caterpillar limit of 25. The viscosity increase for Sample C was 0.24 cSt over the fresh oil at the same hours of engine service when Sample E reached the Caterpillar limit of 3 cSt.

The calculation formula for Relative Percent Improvement for Table 11 is:

$$\text{Relative Percent Improvement}=(\text{Sample}(x)-\text{Sample } E)/\text{Sample}(x)\times 100\%$$

TABLE 11

| | Sample C | Sample E |
|---|---|---|
| Hours to Reach Caterpillar Limit for Oxidation | 1812 | 969 |
| Relative Percent Improved Comparison to Sample E for Oxidation | 87 | 0 |
| Hours to Reach Caterpillar Limit for Nitration | 27,778* | 2033* |
| Relative Percent Improved Comparison to Sample E for Nitration | 1267 | 0 |
| Nitration DIR values at equal engine hours when Sample E reached Caterpillar Limit | 1.83 | 25.00 |
| Hours to Reach Caterpillar Limit for Viscosity Increase | 15,000* | 1200 |
| Relative Percent Improved Comparison to Sample E for Viscosity Increase | 1150 | 0 |
| Viscosity Increase values at equal engine hours when Sample E reached Caterpillar Limit | 0.24 | 3.00 |
| Hours to Reach Caterpillar Limit for TBN | 1152 | 573 |
| Relative Percent Improved Comparison to Sample E for TBN | 101 | 0 |
| Hours to Reach Caterpillar Limit for TAN | 1667 | 800 |
| Relative Percent Improved Comparison to Sample E for TAN | 108 | 0 |

*Note
The nitration level and viscosity increase hours for Sample C were estimated based on trend analysis of the Used Oil Analysis (UOA). Also, the viscosity increase hours for Sample E were estimated based on trend analysis of the Used Oil Analysis (UOA)

Example 6

Sample B was compared to Samples A, J and K for resistance to oxidation using the test procedure described in Example 1. The results of this test are presented in Table 12. These results indicate that Samples A, J and K work surprisingly better than Sample B. The only difference in Sample B and Samples A, J, and K is that Sample B includes Group I base oil, whereas Samples A, J and K include Group II, III, and IV base oils, respectively. These results show that this additive works surprisingly better when combined with Groups II, III, and IV base oil than the same additive when used in Group I base oil.

TABLE 12

Oxidation Resistance of an Additive When Combined With Groups I, II, III and IV Base Oil

| Group of Base Oil | Group I Sample B | Group II Sample A | Group III Sample J | Group IV Sample K |
|---|---|---|---|---|
| Ratio* | 0.64 | 1.00 | 1.20 | 1.14 |
| % Difference** | −36 | 0 | 20 | 14 |

*Ratio - These numbers are relative ratios compared to Sample A's performance in this test. Numbers larger than 1.00 perform better than Sample A and less than 1.00 perform worse than the reference. A higher the ratio number represents higher performance of the sample.
**% Difference - These numbers are the percentage difference between Sample A and the comparative Sample. A negative number indicates worse performance than Sample A.

What is claimed is:

1. A natural gas engine lubricating oil comprising about 0.6 wt. % to about 2.5 wt. % of one or more liquid hindered phenols of the general formula:

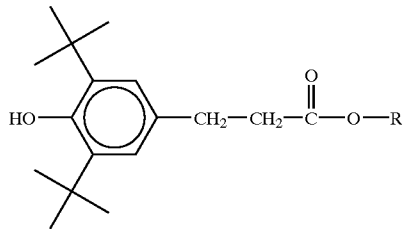

wherein R is a $C_7$ to $C_9$ alkyl group and a major amount of at least one of Group II and Group III base oils, wherein:

said lubricating oil has a total ash content of about 0.1 wt. % to 1.5 wt. % as determined by ASTM D874.

2. The natural gas engine lubricating oil of claim 1 further comprising one or more dispersants, one or more detergents and one or more wear inhibitors.

3. The natural gas engine lubricating oil of claim 1 having a total base number of about 2.15 to about 8.88 as determined by ASTM D2896.

4. The natural gas engine lubricating oil of claim 1 having less than 4000 ppm sulfur.

5. A method of making the natural gas engine lubricating oil of claim 1 comprising:

combining the liquid hindered phenol of claim 1 with the base oil of claim 1 in any order and mixing.

6. A method of lubricating a natural gas engine comprising lubricating one or more natural gas engines with the natural gas engine lubricating oil of claim 1.

7. The natural gas engine lubricating oil of claim 2 wherein said detergent comprises at least one of sulfonate, salicylate and phenate detergents.

8. The natural gas engine lubricating oil of claim 1 wherein about 0.6 wt. % to about 1.25 wt. % of the lubricating oil comprises the liquid hindered phenol.

9. The natural gas engine lubricating oil of claim 1 wherein said lubricating oil has a total ash content of about 0.3 wt. % to 0.95 wt. % as determined by ASTM D874.

10. The natural gas engine lubricating oil of claim 1 wherein said lubricating oil has a total ash content of greater than 0.15 wt. % to less than 1.0 wt. % as determined by ASTM D874.

11. The natural gas engine lubricating oil of claim 1 wherein said lubricating oil has a total ash content of greater than 0.15 wt. % to less than 0.6 wt. % as determined by ASTM D874.

12. The natural gas engine lubricating oil of claim 1 wherein said lubricating oil has a total ash content of greater than 0.6 wt. % to less than 1.0 wt. % as determined by ASTM D874.

13. The natural gas engine lubricating oil of claim 1 wherein said lubricating oil contains no Group III base oil.

14. A method for lubricating a natural gas fueled engine comprising lubricating the natural gas fueled engine with the natural gas engine lubricating oil of claim 7.

15. A natural gas engine lubricating oil comprising:

about 1 wt. % to about 8 wt. % of one or more dispersants;

about 1 wt. % to about 8.5 wt. % of one or more detergents;

about 0.2 wt. % to about 1.5 wt. % of one or more wear inhibitors;

about 0.6 wt. % to about 2.5 wt. % liquid 3,5-di-t-butyl 4-hydroxy phenol propionate, $C_7$–$C_9$ alkyl ester; and about 6 wt. % to about 97 wt. % of at least one of Group II and Group III base oil; wherein, said lubricating oil has a total ash content of about 0.1 wt. % to 1.5 wt. % as determined by ASTM D874.

16. The natural gas engine lubricating oil of claim 15 wherein about 0.6 wt. % to about 1.25 wt. % of the lubricating oil comprises the liquid hindered phenol.

17. The natural gas engine lubricating oil of claim 15 wherein said lubricating oil has a total ash content of about 0.3 wt. % to 0.95 wt. % as determined by ASTM D874.

18. The natural gas engine lubricating oil of claim 15 wherein said lubricating oil has a total ash content of greater than 0.15 wt. % to less than 1.0 wt. % as determined by ASTM D874.

19. The natural gas engine lubricating oil of claim 15 wherein said lubricating oil has a total ash content of greater than 0.15 wt. % to less than 0.6 wt. % as determined by ASTM D874.

20. The natural gas engine lubricating oil of claim 15 wherein said lubricating oil has a total ash content of greater than 0.6 wt. % to less than 1.0 wt. % as determined by ASTM D874.

21. The natural gas engine lubricating oil of claim 15 wherein said lubricating oil contains no Group III base oil.

22. A method of lubricating a natural gas engine comprising contacting one or more natural gas engines with the natural gas engine lubricating oil of claim 15.

23. A natural gas engine lubricating oil comprising:

about 1 wt. % to about 8 wt. % of one or more dispersants;

about 1 wt. % to about 8.5 wt. % of one or more detergents;

about 0.2 wt. % to about 1.5 wt. % of one or more wear inhibitors;

about 0.6 wt. % to about 2.5 wt. % liquid 3,5-di-t-butyl 4-hydroxy phenol propionate, $C_7$–$C_9$ alkyl ester as an anti-oxidant; and about 6 wt. % to about 97 wt. % of at least one of Group II and Group III base oil; wherein, said lubricating oil has a total ash content of about 0.1 wt. % to 1.5 wt. % as determined by ASTM D874, and said lubricating oil contains no other antioxidant additive.

24. The natural gas engine lubricating oil of claim 23 wherein about 0.6 wt. % to about 1.25 wt. % of the lubricating oil comprises the liquid hindered phenol.

25. The natural gas engine lubricating oil of claim 23 wherein said lubricating oil has a total ash content of about 0.3 wt. % to 0.95 wt. % as determined by ASTM D874.

26. The natural gas engine lubricating oil of claim 23 wherein said lubricating oil has a total ash content of greater than 0.15 wt. % to less than 1.0 wt. % as determined by ASTM D874.

27. The natural gas engine lubricating oil of claim 23 wherein said lubricating oil has a total ash content of greater than 0.15 wt. % to less than 0.6 wt. % as determined by ASTM D874.

28. The natural gas engine lubricating oil of claim 23 wherein said lubricating oil has a total ash content of greater than 0.6 wt. % to less than 1.0 wt. % as determined by ASTM D874.

29. The natural gas engine lubricating oil of claim 23 wherein said lubricating oil contains no Group III base oil.

30. A natural gas engine lubricating oil comprising:

about 0.6 wt. % to about 2.5 wt. % of one or more liquid hindered phenols of the general formula:

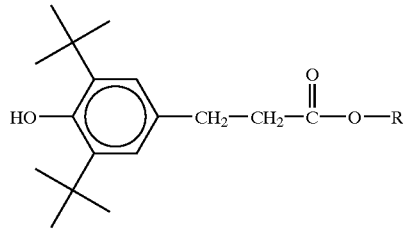

wherein R is a $C_7$ to $C_9$ alkyl group;

a molybdenum oxidation inhibitor;

and a major amount of at least one of Group II and Group III base oils; wherein:

said lubricating oil has a total ash content of about 0.1 wt. % to 1.5 wt. % as determined by ASTM D874; and the concentration of the molybdenum oxidation inhibitor is no more than 0.5 wt. %.

31. The natural gas engine lubricating oil of claim 30 wherein about 0.6 wt. % to about 1.25 wt. % of the lubricating oil comprises the liquid hindered phenol.

32. The natural gas engine lubricating oil of claim 30 wherein said lubricating oil has a total ash content of about 0.3 wt. % to 0.95 wt. % as determined by ASTM D874.

33. The natural gas engine lubricating oil of claim 30 wherein said lubricating oil has a total ash content of greater than 0.15 wt. % to less than 1.0 wt. % as determined by ASTM D874.

34. The natural gas engine lubricating oil of claim 30 wherein said lubricating oil has a total ash content of greater than 0.15 wt. % to less than 0.6 wt. % as determined by ASTM D874.

35. The natural gas engine lubricating oil of claim 30 wherein said lubricating oil has a total ash content of greater than 0.6 wt. % to less than 1.0 wt. % as determined by ASTM D874.

36. The natural gas engine lubricating oil of claim 30 wherein said lubricating oil contains no Group III base oil.

37. The natural gas engine lubricating oil of claim 30 wherein said concentration of the molybdenum oxidation inhibitor is no more than 0.3 wt. %.

38. A natural gas engine lubricating oil comprising:

about 0.2 wt. % to about 3.0 wt. % of one or more liquid hindered phenols of the general formula:

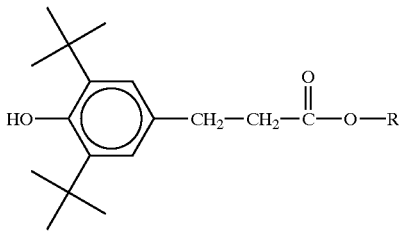

wherein R is a $C_7$ to $C_9$ alkyl group;

and a major amount of at least one of Group II and Group III base oils; wherein:

said lubricating oil has a total ash content of about 0.1 wt. % to 1.5 wt. % as determined by ASTM D874; and said lubricating oil contains no molybdenum oxidation inhibitor.

39. The natural gas engine lubricating oil of claim 38 wherein about 0.6 wt. % to about 2.5 wt. % of the lubricating oil comprises the liquid hindered phenol.

40. The natural gas engine lubricating oil of claim 38 wherein about 0.6 wt. % to about 1.25 wt. % of the lubricating oil comprises the liquid hindered phenol.

41. The natural gas engine lubricating oil of claim 38 wherein said lubricating oil has a total ash content of about 0.3 wt. % to 0.95 wt. % as determined by ASTM D874.

42. The natural gas engine lubricating oil of claim 38 wherein said lubricating oil has a total ash content of greater than 0.15 wt. % to less than 1.0 wt. % as determined by ASTM D874.

43. The natural gas engine lubricating oil of claim 38 wherein said lubricating oil has a total ash content of greater than 0.15 wt. % to less than 0.6 wt. % as determined by ASTM D874.

44. The natural gas engine lubricating oil of claim 38 wherein said lubricating oil has a total ash content of greater than 0.6 wt. % to less than 1.0 wt. % as determined by ASTM D874.

45. The natural gas engine lubricating oil of claim 38 wherein said lubricating oil contains no Group III base oil.

46. A method of lubricating a natural gas engine comprising lubricating one or more natural gas engines with the natural gas engine lubricating oil of claim 38.

* * * * *